US007497039B2

(12) United States Patent
Zhu et al.

(10) Patent No.: US 7,497,039 B2
(45) Date of Patent: Mar. 3, 2009

(54) MOTION PICTURE DISPLAY APPARATUS

(76) Inventors: Shiqi Zhu, 241 E. German School Rd., Richmond, VA (US) 23224; Lincong Yang, Henghu Industrial Park, Wenling City, Zhejiang Province (CN) 317500

( * ) Notice: Subject to any disclaimer, the term of this patent is extended or adjusted under 35 U.S.C. 154(b) by 0 days.

(21) Appl. No.: 12/073,536

(22) Filed: Mar. 6, 2008

(65) Prior Publication Data

US 2008/0148610 A1 Jun. 26, 2008

Related U.S. Application Data

(63) Continuation-in-part of application No. 11/901,352, filed on Sep. 17, 2007.

(51) Int. Cl.
*G09F 11/12* (2006.01)

(52) U.S. Cl. ..... 40/472; 40/524

(58) Field of Classification Search ..... 40/473, 40/472, 524

See application file for complete search history.

(56) References Cited

U.S. PATENT DOCUMENTS 1,579,597 A * 4/1926 Craig ..... 40/438
5,144,328 A * 9/1992 Blake et al. ..... 347/101

* cited by examiner

*Primary Examiner*—Cassandra Davis
(74) *Attorney, Agent, or Firm*—John S. Hale; Gipple & Hale

(57) ABSTRACT

The invention is directed toward a motion picture display apparatus constructed with a casing, an undulating lens mounted on the casing, a motor mounted in the casing, and a background picture disposed on rear of the display apparatus. The motion picture display apparatus is driven by a motor and drive assembly comprising a driving shaft connected to the motor, a driven shaft and a transparent film which is rotatably connected between the driving shaft and the driven shaft in an endless rotating manner. The dynamic picture comprises a plurality of designs having at least two design layers, and the contents and colors of the design layer are identically printed on the film and viewable from the obverse and reverse surfaces. A light source disposed on a rear portion of the background picture illuminates the background picture.

17 Claims, 6 Drawing Sheets

MOTION PICTURE DISPLAY APPARATUS

RELATED APPLICATIONS

There is application is a continuation in part of application Ser. No. 11/901,352, filed Sep. 17, 2007, which claims priority to Chinese Patent Application Number 2006201315033, filed on Aug. 13, 2006. U.S. application Ser. No. 11/901,352 and Chinese Patent Application Number 2006201315033 are incorporated herein by reference.

STATEMENT REGARDING FEDERALLY SPONSORED RESEARCH OR DEVELOPMENT

Not applicable.

REFERENCE TO SEQUENCE LISTING, A TABLE OR A COMPUTER PROGRAM LISTING COMPACT DISC APPENDIX

None.

BACKGROUND OF THE INVENTION

1. Field of Invention

The present invention relates to a motion picture display apparatus, and more particularly to a motion picture display apparatus suitable for displaying an effect of multilayer pictures.

2. Background of the Invention

Kinetic decorative objects simulating an aquarium are known in the prior art. Typically these devices include an endless loop of transparent or translucent material driven between two rollers. Depictions of marine life are printed on the endless loop and rotation of the loop over the rollers simulates motion. However, the simulation of a marine tableau in these devices is quite rudimentary. These arrangements are only able to simulate movement in one direction with the result that the marine life depictions on the endless loop appear to constantly "swim" in one direction, subsequently disappearing at one side of the device, then reappearing moments later from the opposing side.

In the prior art, a motion picture display apparatus uses a dynamic film endless loop and a fixed background picture interposed within the loop in order to show its effect of single layer pictures. The dynamic picture of these devices is generally a single layer picture, and the devices are unable to provide a variety of dynamic pictures.

What is needed is a more realistic simulation of an aquarium.

SUMMARY OF THE INVENTION

The subject of the present invention is a moving picture display apparatus providing the effect of multilayer pictures and a more realistic, three dimensional effect. The moving picture display apparatus embodied by the present invention is constructed with a casing, a transparent undulating lens mounted on the casing, a transparent endless loop rotatably connected between a driving shaft and driven shaft, and a background picture disposed at the rear of the casing. The endless loop is printed with superimposed mirror image depictions of marine life on its obverse and reverse surfaces. Accordingly, rotation of the endless loop exposes both the obverse and reverse surfaces of the loop to the viewer, thereby simulating movement in multiple opposing directions. The refractive qualities of the undulating lens through which the aforementioned endless loop arrangement is viewed further enhances its three dimensional experience.

The dynamic moving picture device is driven by the motor. The moving picture display further comprises a driving shaft, a driven shaft and a transparent film which is rotatably connected between the driving shaft and the driven shaft in an endless rotating manner. The driving shaft is connected with the motor. The dynamic picture device is driven by the motor rotated in front of the background picture. The dynamic picture comprises a plurality of designs having at least two design layers, and the contents and colors of the design layer are identically printed on the film. A light source disposed on a rear portion of the background picture illuminates the background picture.

The transparent film has equivalent internal and external design layers, providing the same transparent design whether viewing the image from the obverse or reverse. The motion picture display apparatus may reduce friction and noise and adjust difference of speed as the two rollers of the driven shaft rotate independently, allowing the film to rotate in a smooth manner and the rollers maintain the proper positioning of the film. The background picture may be composed of a transparent film or transparent board with designs.

These and other objects, advantages, and novel features of the present invention will become apparent when considered with the teachings contained in the detailed disclosure along with the accompanying drawings.

DESCRIPTION OF THE INVENTION

Figure 2:
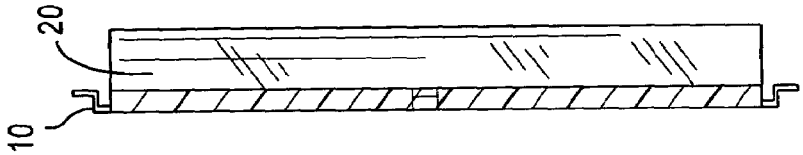
FIG. 2 is a cross sectioned view taken from lines 2'- 2' of FIG. 1.
Figure 1:
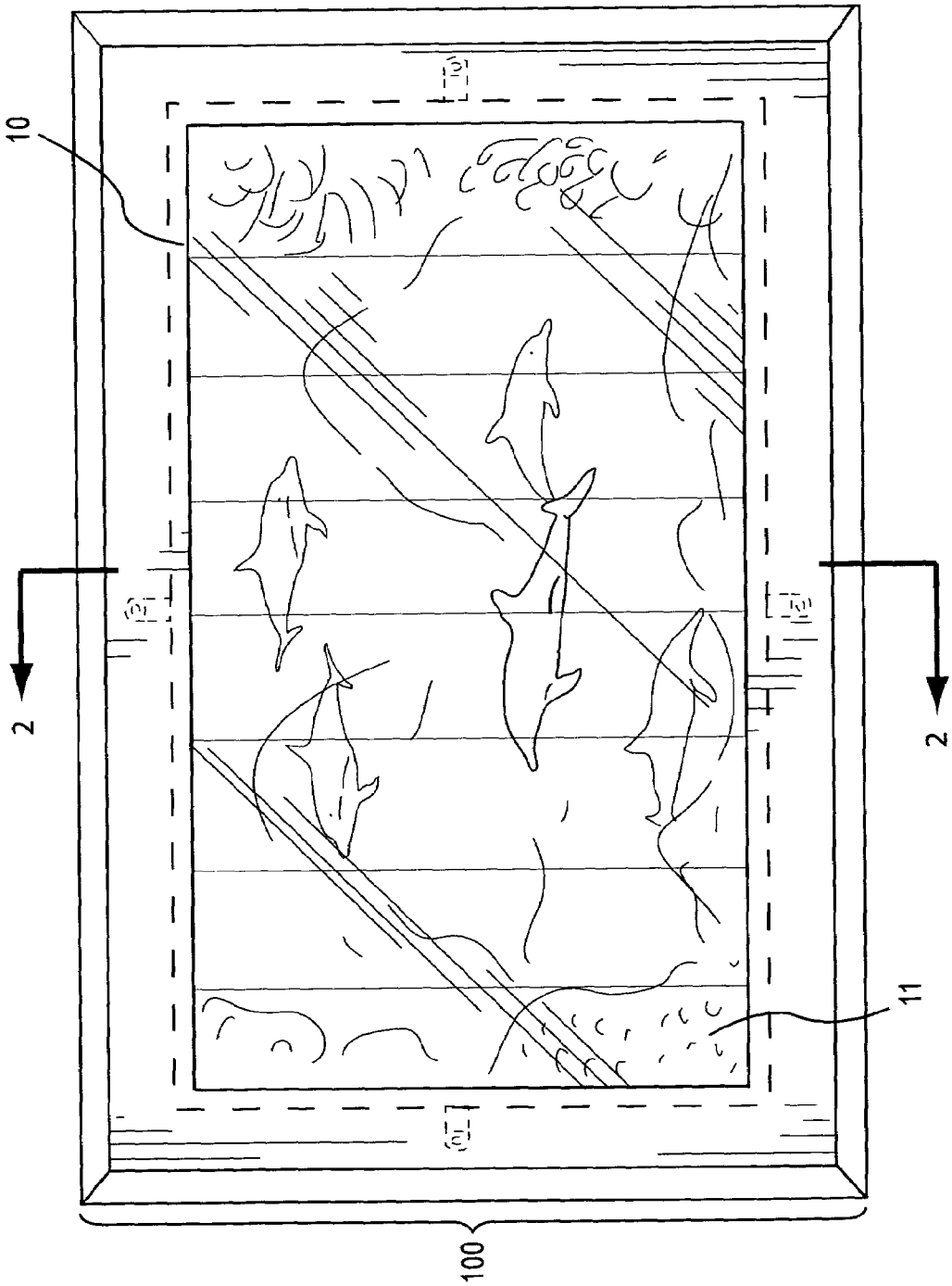
FIG. 1 is an elevation of the moving picture apparatus invention.

The subject of the present invention is directed towards a kinetic decorative object simulating an aquarium. The invention may be constructed from any moldable material, but in a preferred embodiment, is constructed from plastic, including but not limited to various nylon formulations, polyvinyl chloride, polyethylene, polyfluoroethylene, polypropylene, polymethyl methacrylate, and other acrylics, silicones, polyurethanes, or their composites. The preferred embodiment and best mode of the invention is shown in FIGS. 1-8. Referring to FIGS. 1 through 5, views of the moving picture display apparatus 100 according to an exemplary embodiment are shown. Motion picture display apparatus 100 comprises a generally parallelepiped casing 20, an undulating lens 10 (best seen in FIG. 7) mounted on the casing 20, a drive mechanism in the form of a motor 21 mounted in the casing 20, a transparent film 53 forming an endless loop driven by the motor 21, and a light source 22 disposed on a rear portion of a background picture 11 illuminating the background picture 11. An endless loop mechanism drives the endless loop and comprises a driving shaft 51, a driven shaft 52 and the transparent film 53 rotatably connected between the driving shaft 51 and the driven shaft 52 in an endlessly rotatable manner. The driving shaft 51 is connected to the motor 21.

Figure 4:
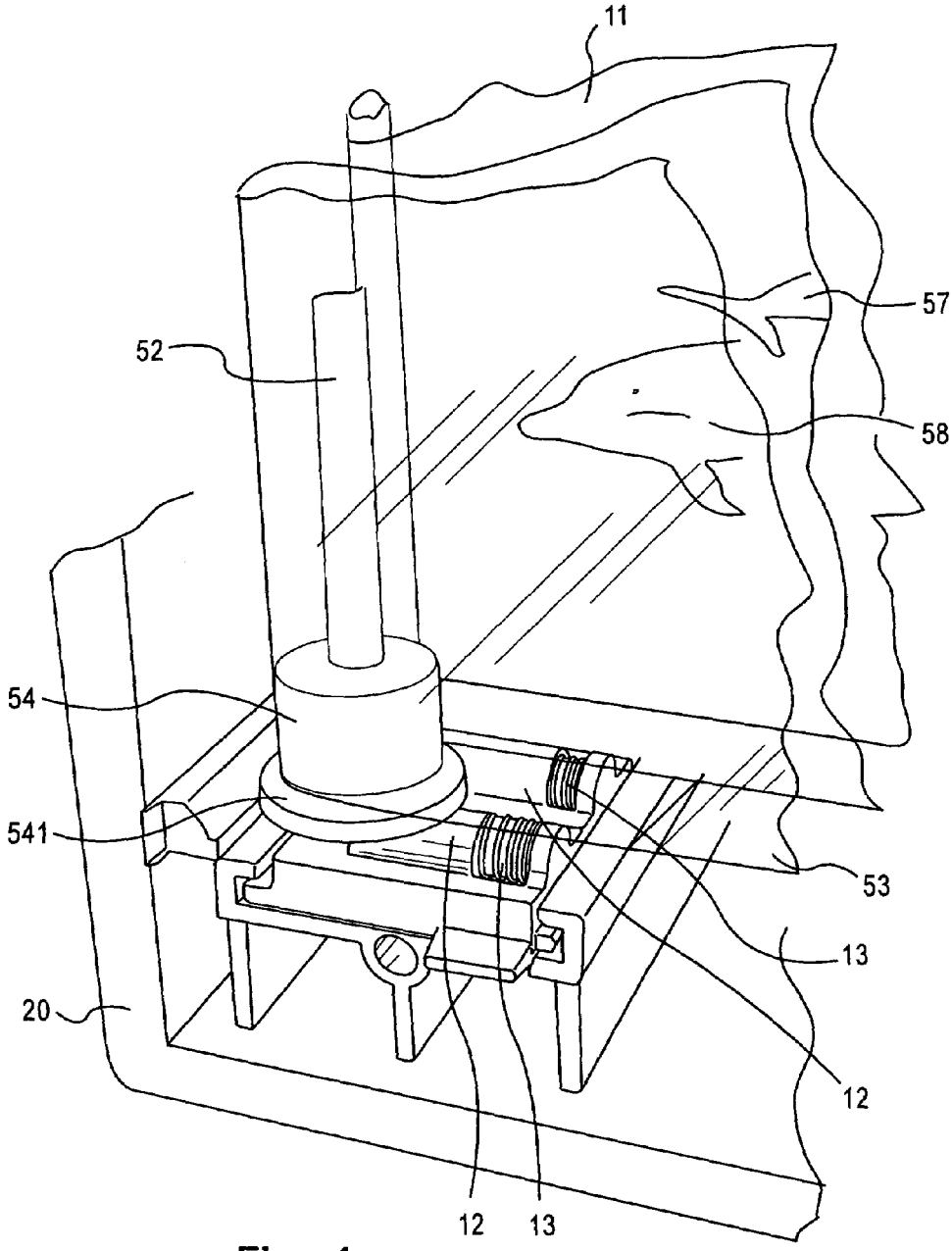
FIG. 4 is a detailed perspective view of the area labeled "A" in FIG. 3.
Figure 5:
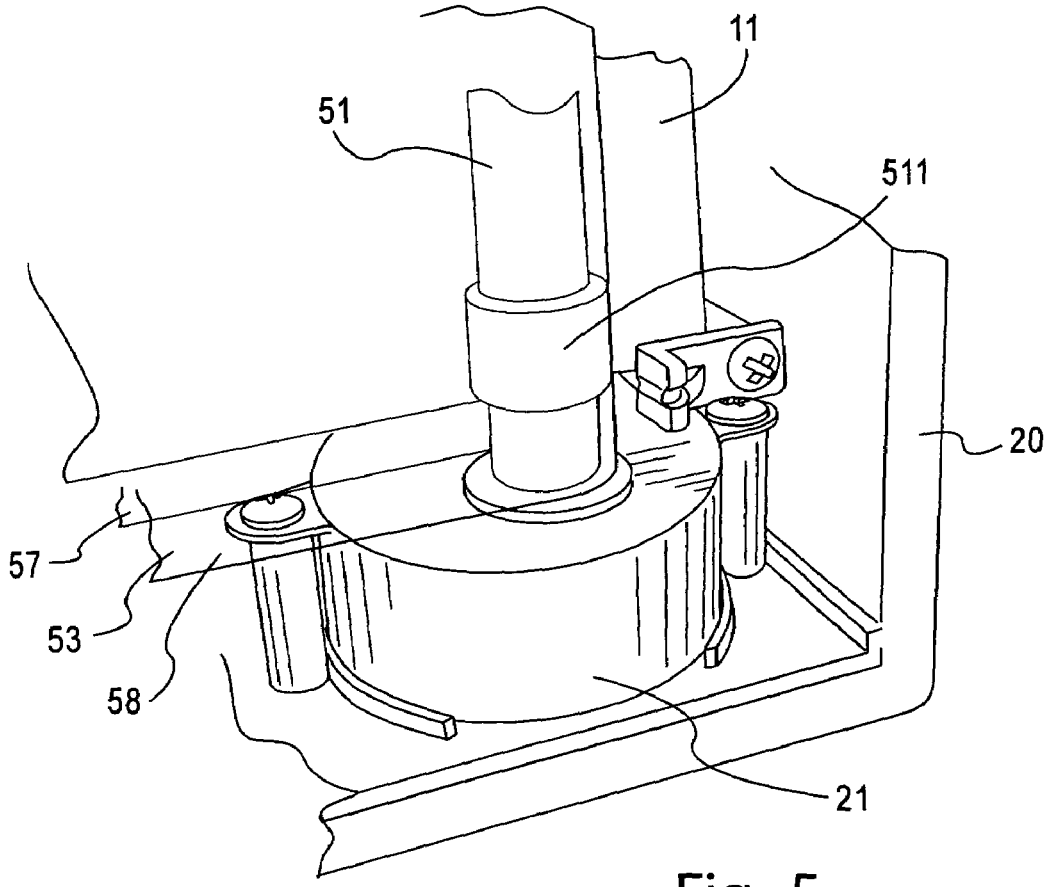
FIG. 5 is a detailed perspective view of the area labeled "B" in FIG. 3.
Figure 6:
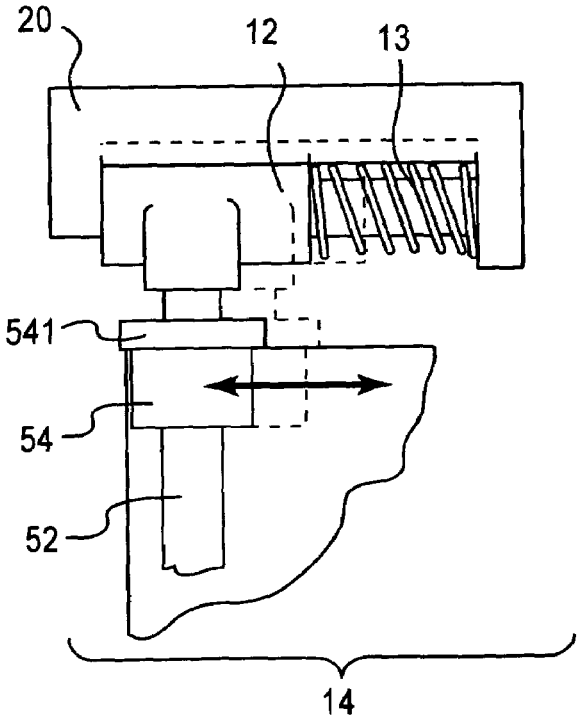
FIG. 6 is a detailed elevation of view of the area labeled "C" in FIG. 3.

Referring now to FIGS. 4, 5, and 6, the motor 21 shown in FIG. 5 is mounted in a casing 20 which includes a rear element, opposing sidewalls, and opposing top and base walls. The motor 21 is mounted at one end of the casing 20 on the base wall with an axis of rotation generally parallel to one sidewall. The driving shaft 51 is mounted co-axially with the arbor of motor 21 and is fixed to the casing 20 at its distal end (not shown) in a manner permitting free rotation. A driven shaft 52 is mounted at the opposite end of the casing 20 via an elastic slide rod assembly 14 at each end of the aforementioned shaft 52 (schematic representation of upper assembly shown in FIG. 6). A transparent film 53 forming an endless loop is functionally engaged with the driving shaft 51 and driven shaft 52, with the transparent film interior surface 57 of the endless loop positioned adjacent the shafts 51, 52.

Referring to FIGS. 4 and 6, rollers 54 are mounted respectively at the two ends of the driven shaft 52 and may be freewheeling to rotate independently of the shaft 52 or may be fixed to the shaft 52 and rotate in concert with same. The transparent film 53 is rotatably connected between the rollers 54 and the driving shaft 51 so that the generated friction and noise may be reduced and the difference of speed of the transparent film 53 may be compensated.

Referring to FIG. 5, the driving shaft 51 includes separation sleeves 511 constructed from a resilient material, with the transparent film 53 being rotatably mounted thereon. The separation sleeves 511 enhance friction, thereby preventing the film 53 from skidding, slipping or scratching.

Figure 3:
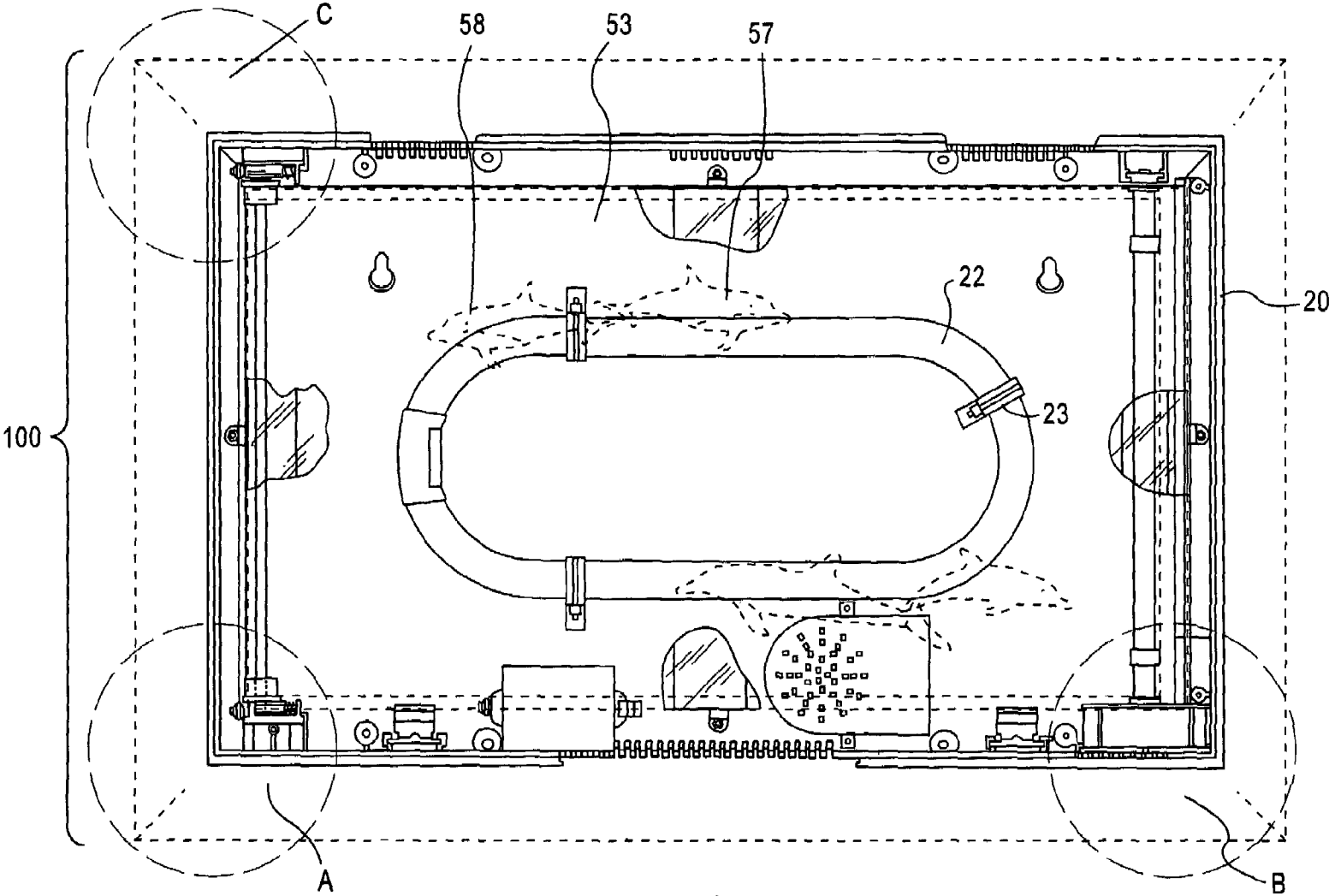
FIG. 3 shows the apparatus in FIG. 1 with its front panel in phantom.

Referring to FIGS. 3, 4 and 5, two ends of the background picture 11 may be mounted adjacent the rear element of the casing 20, interposed in front of the light source 22, an oval fluorescent tube which is held in place by bracket 23, and behind the transparent film 53. Alternatively, the background picture may be tensioned against background picture mounting rods 55, which are in turn mounted adjacent to the casing 20 and behind the transparent film 53 to provide tightened fixing of the background picture 11 to the casing 20. The background picture 11 may itself be composed of a transparent film. The background picture 11 may also be composed of transparent board material.

Figure 8:
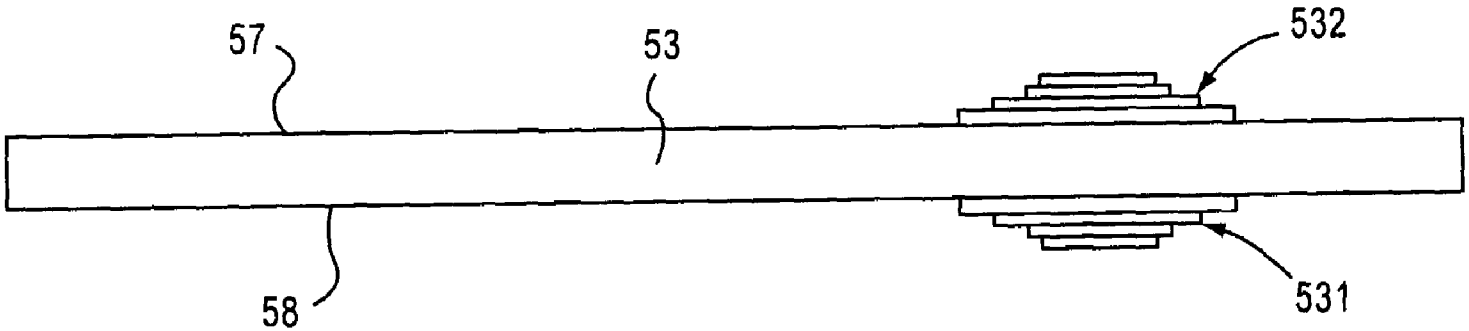
FIG. 8 shows the transparent film, schematically representing the pigment layers comprising the mirror image designs of the preferred embodiment; and, FIG. 9 shows the transparent film, schematically representing the pigment layers comprising the mirror image designs of an alternative embodiment.
Figure 9:
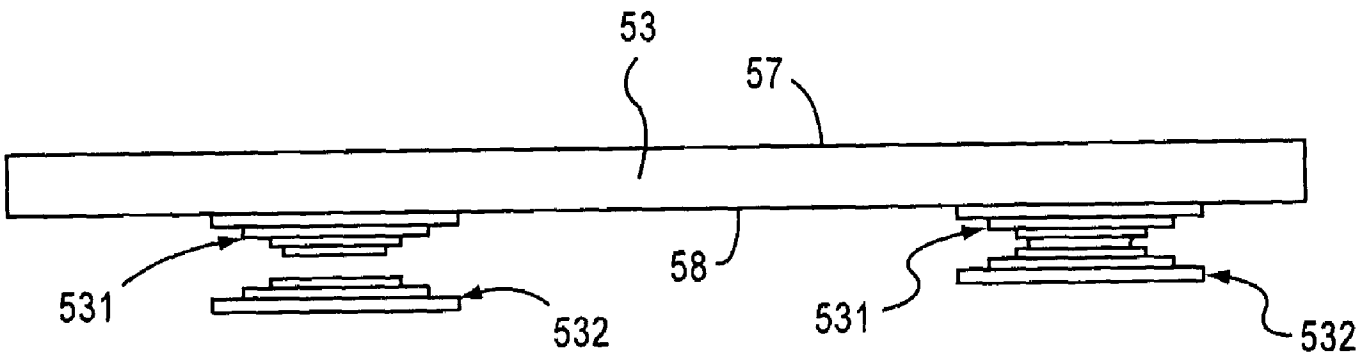

Turning now to FIGS. 8 and 9, a first image 531 and complimentary second image 532 are printed on the transparent film 53. The film 53 comprises a reverse, transparent film interior surface 57, and an obverse, transparent film exterior surface 58. In a preferred embodiment, the first image 531 comprises multiple layers of pigment applied in a first sequence to either the obverse or reverse surface of the transparent film 53. The complimentary second image 532 comprises multiple layers of pigment, each shaped to mirror the layers found in the first image 531, applied to the obverse or reverse surface not occupied by the first image 531. The images are applied in a superimposed fashion such that the undecorated rear surfaces of the images are not visible. In the embodiment shown in FIG. 8, the layers of pigment comprising the complimentary second image 532 are applied in the same sequence as that used to create the first image 531.

An alternative embodiment is shown in FIG. 9 wherein both the first image 531 and complimentary second image 532 are applied to the same surface of the transparent film 53. The images are created in a similar fashion to that described in FIG. 8 except that in this embodiment, the layers of pigment comprising the complimentary second image 532 must be applied in a second sequence that is opposite the aforementioned first sequence used for creating the first image 531. Therefore the effect of viewing the designs on the transparent film 53 according to the present invention is equivalent regardless of who is viewing the transparent film 53 from either of an obverse or a reverse side. In addition, a greater dynamic effect is achieved and when the designs of the transparent film 53 are rotated from the obverse to the reverse, because the background picture 11 is disposed in back of the aforementioned film 53.

Note that the designs applied to the transparent film 53 do not require mirror image designs so long as they completely superimpose one another when viewed from the obverse and reverse surfaces of the transparent film 53. The first image 531 may differ substantially from the complimentary second image 532 so long as their silhouettes are mirror images of one another and the respective images superimpose one another when viewed on the transparent film 53. Alternative embodiments may include, for example, completely different forms of sea life or depict color variations between species on the first image 531 and complimentary second image 532.

Referring to FIG. 9, the first image 531 and complimentary second image 532 may both be comprised of multi-layer overprinted design layers. The sequence of overprinting the layers of the first image 531 and the complimentary second image 532 may be reverse with respect to one another. For instance, both design layers may be printed on the same surface of the transparent film 53, with one layer printed in a reverse order. For example, the sequence of print may be: affixing the design layers comprising the first image 531 in a first order, then affixing the design layers comprising the complimentary second image 532 in a second order that is the reverse of the first order. As the design is viewed from the obverse and reverse of the transparent film 53, the image is the same. It is contemplated that for one side and position of the transparent film 53, equivalent design layers are overprinted two times with a different sequence.

Referring to FIG. 8, the first image 531 is printed on the obverse of the transparent film 53, and the complimentary second image is printed on the reverse of the film 53.

Referring to FIGS. 4 and 6, the two ends of the driven shaft 52 are fixed on an elastic slide rod assembly 14 mounted to the casing 20. The elastic slide rod assembly 14 comprise two slide rods 12 and coil springs 13. The slide rods 12 are reciprocatingly movable along an axis generally perpendicular to the axis of the driven shaft and are generally cylindrical in shape and inserted into the coil of the springs 13. An increase in the diameter of the slide rods approximately midpoint forms a stepped stop and prevents further movement of the springs 13. Similarly, the distal end of the springs 13 bear against bolsters molded either into the casing 20 or into the elastic slide rod assembly 14. The springs 13 are thus held captive on the elastic slide rod assembly 14. In operation, an elastic slide rod assembly 14 is mounted opposite the driving shaft 51 and to the top and bottom walls of the casing 20 with the springs 13 in a compressed state. Bores formed in the slide rods 12 perpendicular to their axis of motion accommodate the distal end of a nipple extending from the driven shaft 52 while allowing free rotation of the aforementioned shaft 52. The driven shaft 52 is thereby biased outwardly, sufficiently tensioning the transparent film 53 endless loop to ensure reliable operation. Those skilled in the art will recognize that the driven shaft 52 may also be outwardly biased by tension exerted by extended springs, or through a combination of extended and compressed springs. In a preferred embodiment, the elastic slide rod assembly 14 pushes the driven shaft 52, so that the transparent film 53 is tightened. Flanged ends 541 molded onto the rollers 54 function as position limiters for the transparent film loop to further assure reliable rotation of the transparent film 53 comprising the endless loop. Therefore the flanged ends 541 may prevent the transparent film 53 from shifting out of position during rotation.

Referring now to FIG. 3, the light source 22 is positioned behind the background picture 11 in order to provide light for the apparatus. The light source 22 may also be positioned adjacent to a sidewall of the casing 20 while maintaining proper illumination of the background picture 11. Moreover, the light source 22 may be located behind the background picture 11 or on a lateral side of the casing 20. In the instant invention, the light source 22 is an oval fluorescent lamp. Those skilled in the art will recognize that other methods of illumination are available, including light emitting diodes (LEDs) and incandescent fixtures.

Figure 7:
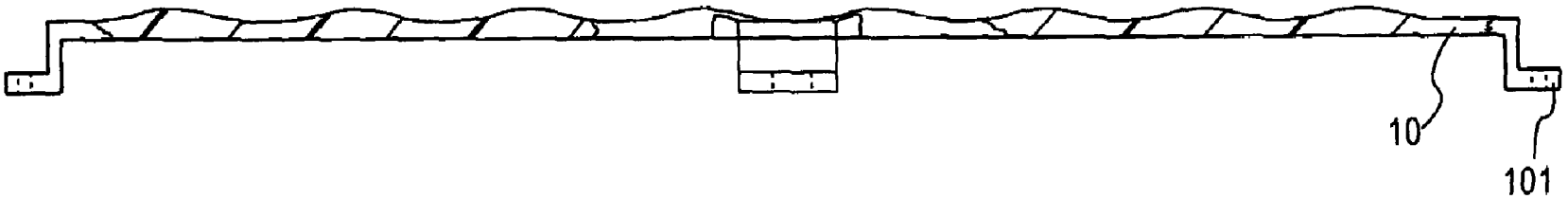
FIG. 7 is a cross-section of the undulating lens of the preferred embodiment.

Referring to FIG. 7, a cross section of the undulating lens 10 is shown. The lens 10 is also shown in phantom in FIG. 1, mounted to the casing 20, wherein its light transmissive qualities enhance the verisimilitude of the designs applied to the endless loop of transparent film 53 viewed therethrough. In a preferred embodiment, the lens 10 is generally rectangular and sized to cover the space defined by the sidewalls, top and bottom walls, and rear element of the casing 20. Mounting tabs 101 are positioned at approximately the midpoint of each side of the casing 20 to facilitate attachment to the casing. The undulating lens 10 includes a generally planar first surface and a second surface with a generally sinusoidal cross section along a line perpendicular to either sidewall of the casing 20. A cross section of the lens 10 taken along a line perpendicular to either the top or bottom wall of the casing 20 is generally rectilinear such that the lens 10 surface forms a wave-like pattern molded into the lens. Refractive qualities of the lens 10 cause images viewed therethrough, in this case, the marine life designs comprising the first and complimentary second images 531, 532, to simulate a swimming motion. While the regular, sinusoidal undulations of the preferred embodiment has been found to best simulate a swimming motion, it is understood that the undulating lens 10 surface need not be shaped in this manner. Other refractively active shapes may be molded into the lens to, for example, whimsically distort the images viewed therethrough.

In operation, power supplied to the electric motor 21 causes axial rotation of the driving shaft 51 mounted therein, which in turn causes rotation of the transparent film 53, which is formed into an endless loop and rotatably mounted between the driving 51 and driven 52 shafts. The transparency of the film 53 and placement of the background picture 11 behind the endless loop assembly permits viewing both the obverse, transparent film exterior surface 58 and reverse, transparent film interior surface 57 and the images applied thereon. Any first image 531 of the instant invention therefore appears to swim in one direction. Its complimentary second image 532 appears to swim in the opposing direction. A multiplicity of first and complimentary second images 532, 532 in the present invention results in a pleasing, more realistic simulation of marine line swimming in multiple directions beneath the ocean's surface.

Whereas previously known devices simulate motion in only one direction, the novel construction of the transparent film 53 comprising the endless loop of the instant invention, and placement of the background picture 11 behind the endless loop permits the viewer to experience images on both the obverse and reverse surfaces of the film 53. Images applied to the obverse surface of the transparent film 53 appear to be moving in one direction, and those applied on the reverse appear to move in the opposite direction. Moreover, the illusion of a swimming motion is enhanced by viewing the entire tableu through the undulating lens 10 mounted at the frontmost portion of the casing 20.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What is claimed is:

1. A decorative apparatus for presenting visual images comprising:

a casing having a rear wall, opposing sidewalls, a top and base;

a background picture mounted adjacent said rear wall;

a drive mechanism mounted to said casing;

a driving shaft rotatably mounted to said drive mechanism, said driving shaft being mounted adjacent to one of said sidewalls;

a driven shaft mounted to said casing, said driven shaft being oriented parallel to said driving shaft and mounted adjacent a sidewall;

an endless loop of transparent film having decorative designs applied thereon, said transparent film having an interior surface and an exterior surface, said interior surface being in communication with said driving and driven shafts, said transparent film being rotatably driven by said drive mechanism;

said transparent film having identical, superimposed, mirror image designs applied thereon; and an undulating lens mounted to the front of said casing with said transparent film being viewable through said lens.

2. A decorative apparatus as claimed in claim 1 wherein a cross section of said undulating lens is sinusoidal.

3. A decorative apparatus as claimed in claim 1 wherein said undulating lens is irregularly undulating.

4. A decorative apparatus as claimed in claim 1 wherein said mirror image designs are mirror image silhouettes.

5. A decorative apparatus as claimed in claim 1 wherein an illumination means is mounted to said casing behind said background picture.

6. A decorative apparatus as claimed in claim 5 wherein said illumination means is a fluorescent lamp.

7. A decorative apparatus as claimed in claim 1 wherein said decorative designs are depictions of marine flora, fauna, or a combination therein.

8. A decorative apparatus as claimed in claim 1 wherein said undulating lens has a generally planar rear surface and a front surface having a generally sinusoidal cross section.

9. A decorative apparatus as claimed in claim 1 wherein said driven shaft is mounted to said casing with captive spring means outwardly biasing said driven shaft to maintain an expansive force against said endless transparent film.

10. A decorative apparatus as claimed in claim 9 wherein said spring means is a coil spring.

11. A decorative apparatus as claimed in claim 1 wherein the ends of said driven shaft are flanged.

12. A decorative apparatus as claimed in claim 1 wherein said driving shaft includes a plurality of circumferential separation sleeves formed from a resilient material.

13. A decorative apparatus as claimed in claim 1 wherein said endless transparent film has an exterior surface and an interior surface, a first image of said mirror image designs is applied to said exterior or interior surface and a complimentary second image of said mirror image designs is superimposed to the complimentary surface.

14. A decorative apparatus as claimed in claim 13 wherein said first image and complimentary second image each comprise multiple pigment layers applied in a fixed sequence.

15. A decorative apparatus as claimed in claim 1 wherein said endless transparent film has an exterior surface and an interior surface and a first image and complimentary second image of said mirror image designs are superimposed and applied to either said exterior or interior surface.

16. A decorative apparatus as claimed in claim 15 wherein said first image comprises multiple pigment layers applied in a fixed sequence to either said exterior or interior surface and said complimentary second image is superimposed on said first image and comprises multiple pigment layers applied in a reverse sequence to the same said exterior or interior surface.

17. A decorative apparatus for presenting visual images comprising:

a casing having a rear wall, opposing sidewalls, a top and base;

a background picture mounted to said casing adjacent said rear wall;

a motor mounted to said casing;

a stepped driving shaft rotatably connected to said motor and said casing top positioned adjacent to one of said sidewalls;

a stepped driven shaft mounted to said casing, said driven shaft being oriented parallel to said driving shaft and mounted to said casing with spring means outwardly biasing said driven shaft against an endless loop of transparent film;

said driven shaft being provided with outwardly extending members defining a planar surface adjacent said loop of transparent film to maintain said loop of transparent material in a predetermined uniform path as it rotates;

said loop of transparent film having an interior surface and an exterior surface, said interior surface engaging a raised stepped portion of said stepped driving and driven shafts, said loop of transparent film being driven by said driving shaft;

said transparent film having identical, superimposed, mirror image designs applied thereon; and an undulating clear lens mounted to the front of said casing with said transparent film being viewable through said clear lens.

* * * * *